US009620863B2

(12) United States Patent
Tanaka et al.

(10) Patent No.: US 9,620,863 B2
(45) Date of Patent: Apr. 11, 2017

(54) ANTENNA DEVICE

(71) Applicant: MURATA MANUFACTURING CO., LTD., Kyoto (JP)

(72) Inventors: Hiroya Tanaka, Kyoto (JP); Kengo Onaka, Kyoto (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 203 days.

(21) Appl. No.: 14/164,054

(22) Filed: Jan. 24, 2014

(65) Prior Publication Data

US 2014/0139388 A1 May 22, 2014

Related U.S. Application Data

(63) Continuation of application No. PCT/JP2012/068670, filed on Jul. 24, 2012.

(30) Foreign Application Priority Data

Jul. 26, 2011 (JP) ..... 2011-163576

(51) Int. Cl.
*H01Q 5/385* (2015.01)
*H01Q 19/00* (2006.01)
(Continued)

(52) U.S. Cl.
CPC ..... *H01Q 19/005* (2013.01); *H01Q 1/243* (2013.01); *H01Q 1/38* (2013.01); *H01Q 5/385* (2015.01); *H01Q 9/285* (2013.01); *H01Q 21/08* (2013.01)

(58) Field of Classification Search
CPC ..... H01Q 5/378; H01Q 5/385; H01Q 5/392
See application file for complete search history.

(56) References Cited

U.S. PATENT DOCUMENTS 6,323,811 B1 11/2001 Tsubaki et al.
7,973,720 B2 7/2011 Sorvala
(Continued)

FOREIGN PATENT DOCUMENTS

CN 1496595 A 5/2004
CN 1595720 A 3/2005
(Continued)

OTHER PUBLICATIONS

The first Office Action issued by the State Intellectual Property Office of People's Republic of China on Sep. 30, 2014, which corresponds to Chinese Patent Application No. 201280035547.4 and is related to U.S. Appl. No. 14/164,054; with English language translation.

(Continued)

*Primary Examiner* — Robert Karacsony
(74) *Attorney, Agent, or Firm* — Studebaker & Brackett PC

(57) ABSTRACT

A first radiating element and a second radiating element each have a first extending portion protruding from a region where a ground conductor is formed to a non-ground-conductor region, and a second extending portion extending parallel with a boundary of the ground-conductor region and the non-ground-conductor region. The first radiating element and the second radiating element are arranged such that an open end of the second extending portion of the first radiating element and an open end of a second extending portion of the second radiating element face each other. A parasitic element is formed on a side of the second radiating element distant from the region (where the ground conductor is formed. A parasitic element is formed along the first radiating element. With this configuration, an antenna device is realized which has gain in two frequency bands and has forward directivity.

6 Claims, 12 Drawing Sheets

(51) Int. Cl.

| | |
|---|---|
| ***H01Q 1/24*** | (2006.01) |
| ***H01Q 1/38*** | (2006.01) |
| ***H01Q 21/08*** | (2006.01) |
| ***H01Q 9/28*** | (2006.01) |

(56) References Cited

U.S. PATENT DOCUMENTS

| | | | | |
|---|---|---|---|---|
| 2004/0027287 | A1* | 2/2004 | Onaka | H01Q 1/243 343/700 MS |
| 2004/0066341 | A1 | 4/2004 | Ito et al. | |
| 2005/0057407 | A1 | 3/2005 | Imaizumi et al. | |
| 2005/0153756 | A1 | 7/2005 | Sato et al. | |
| 2005/0275596 | A1* | 12/2005 | Harano | H01Q 1/243 343/702 |
| 2008/0309562 | A1 | 12/2008 | Tsutsumi et al. | |
| 2008/0316098 | A1 | 12/2008 | Mitsui | |
| 2010/0033383 | A1 | 2/2010 | Yamamoto | |

FOREIGN PATENT DOCUMENTS

| | | | |
|---|---|---|---|
| CN | 1716688 | A | 1/2006 |
| CN | 101330169 | A | 12/2008 |
| EP | 1555715 | A1 | 7/2005 |
| JP | 2004-363848 | A | 12/2004 |
| JP | 2005-086780 | A | 3/2005 |
| JP | 2006-033798 | A | 2/2006 |
| WO | 2006/000631 | A1 | 1/2006 |

OTHER PUBLICATIONS

International Search Report; PCT/JP2012/068670; Sep. 11, 2012.
Written Opinion of the International Searching Authority; PCT/JP2012/068670; Sep. 11, 2012.
The Second Office Action issued by the State Intellectual Property Office of People's Republic of China on Jun. 5, 2015, which corresponds to Chinese Patent Application No. 201280035547.4 and is related to U.S. Appl. No. 14/164,054; with English language summary.

* cited by examiner

ANTENNA DEVICE

CROSS REFERENCE TO RELATED APPLICATIONS

This application claims benefit of priority to Japanese Patent Application No. 2011-163576 filed on Jul. 26, 2011, and to International Patent Application No. PCT/JP2012/068670 filed on Jul. 24, 2012, the entire content of each of which is incorporated herein by reference.

TECHNICAL FIELD

The present technical field relates to an antenna device, and particularly to an antenna device used, for example, for radio communication in a plurality of frequency bands.

BACKGROUND

International Publication No. 2006/000631 and U.S. Pat. No. 6,323,811 each disclose an antenna device having a structure in which open ends of two radiating elements are placed close to each other and power is fed to one of the radiating elements.

Japanese Unexamined Patent Application Publication No. 2004-363848 discloses an antenna device in which one parasitic element for shared use is added to two antennas operated at the same frequency.

Japanese Unexamined Patent Application Publication No. 2005-86780 discloses an antenna device in which, in different applications for the same frequency, each of their null directions is directed to each other's antenna element by adding L-shaped parasitic elements to the corresponding corners of a substrate.

For example, antennas used in wireless fidelity (Wi-Fi), are required to have gain in two frequency bands, a 2.4 GHz band and a 5 GHz band. Electronic apparatuses, such as TVs and DVD and BD players, may include a Wi-Fi antenna that uses a multiple input multiple output (MIMO) system. There is often a wall behind such an electronic apparatus, and access points are often located forward of the electronic apparatus. Given such conditions of use of the electronic apparatus, the intensity of radio waves from the rear of the electronic apparatus may be lower than that of radio waves from the front of the electronic apparatus. This means that directivity with gain higher at the front than at the rear is required.

SUMMARY

Technical Problem

None of the antenna devices disclosed in International Publication No. 2006/000631, U.S. Pat. No. 6,323,811, Japanese Unexamined Patent Application Publication No. 2004-363848 and Japanese Unexamined Patent Application Publication No. 2005-86780 can be used for two frequency bands. None of these documents describe a technique that supports multiple frequency bands away from each other, such as the 2.4 GHz band and the 5 GHz band, and improves forward gain.

Accordingly, an object of the present disclosure is to provide an antenna device that has gain in two frequency bands and has forward directivity.

Solution to Problem (1) An antenna device of the present disclosure includes a substrate, a ground conductor formed on the substrate, and a radiating element formed in a non-ground-conductor region of the substrate, the non-ground-conductor region being a region where the ground conductor is not formed, wherein the radiating element is composed of a first radiating element (feed radiating element) and a second radiating element (parasitic radiating element);

the first radiating element and the second radiating element each have a first extending portion protruding from a ground-conductor region to the non-ground-conductor region, the ground-conductor region being a region where the ground conductor is formed, and a second extending portion extending parallel with a boundary of the ground-conductor region and the non-ground-conductor region; and the first radiating element and the second radiating element are arranged such that an open end of the second extending portion of the first radiating element and an open end of the second extending portion of the second radiating element face each other.

(2) It is preferable that a parasitic element be provided on a side of the first radiating element and the second radiating element distant from the ground conductor, the parasitic element extending along the second extending portion of one or each of the first radiating element and the second radiating element.

(3) The parasitic element preferably has a portion extending along the open ends of the first radiating element and the second radiating element.

(4) The parasitic element preferably has a portion extending along the first extending portion of one of the first radiating element and the second radiating element.

(5) For example, for application to the MIMO system, there may be a plurality of sets of the first radiating element and the second radiating element.

Advantageous Effects of Disclosure

According to the present disclosure, it is possible to obtain an antenna device that has gain in two frequency bands and has forward directivity.

BRIEF DESCRIPTION OF THE DRAWINGS

FIG. 10(A) illustrates characteristics in the low band (2.4 GHz band) and FIG. 10(B) illustrates characteristics in the high band (5 GHz band).

DETAILED DESCRIPTION

First Embodiment

An antenna device and an electronic apparatus according to a first embodiment will be described with reference to the drawings.

Figure 1A:
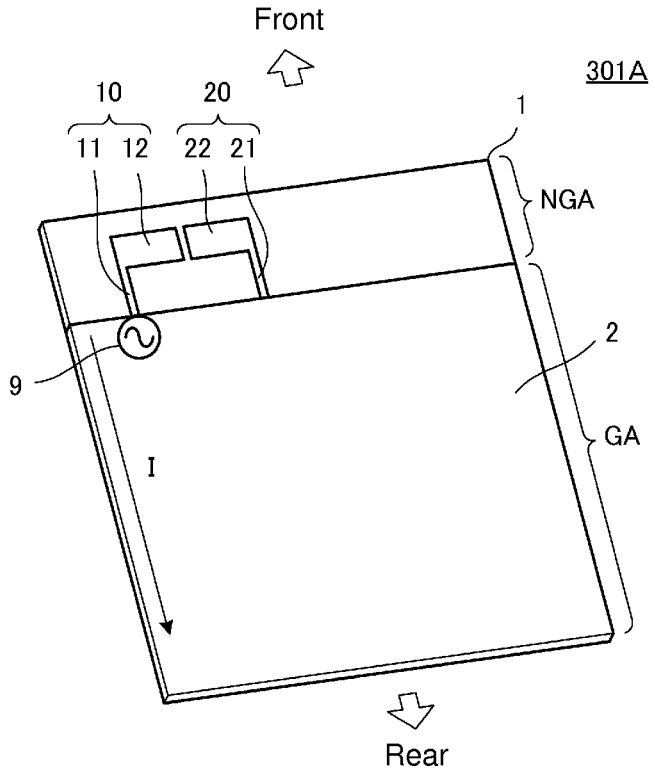
FIG. 1(A) is a perspective view of an antenna device 301A according to a first embodiment.
Figure 1B:
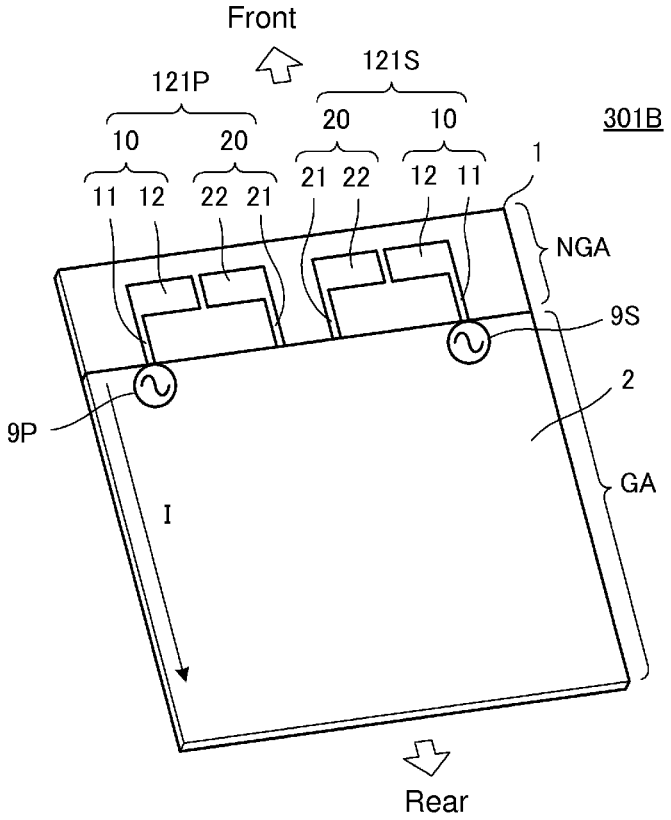
FIG. 1(B) is a perspective view of another antenna device 301B according to the first embodiment.

FIG. 1(A) is a perspective view of an antenna device 301A according to the first embodiment, and FIG. 1(B) is a perspective view of another antenna device 301B according to the first embodiment.

The antenna device 301A illustrated in FIG. 1(A) includes a substrate 1, a ground conductor 2 formed on the substrate 1, and a first radiating element 10 and a second radiating element 20 formed in a non-ground-conductor region NGA of the substrate 1, the non-ground-conductor region NGA being a region where the ground conductor 2 is not formed. The first radiating element 10 is a feed radiating element to which a feeding circuit 9 is connected, and the second radiating element 20 is a parasitic radiating element.

The first radiating element 10 has a first extending portion 11 protruding from a region GA where the ground conductor 2 is formed to the non-ground-conductor region NGA, and a second extending portion 12 extending parallel with a boundary of the ground-conductor region GA and the non-ground-conductor region NGA. The second radiating element 20 has a first extending portion 21 protruding from the region GA where the ground conductor 2 is formed to the non-ground-conductor region NGA, and a second extending portion 22 extending parallel with the boundary of the ground-conductor region GA and the non-ground-conductor region NGA.

The first radiating element 10 and the second radiating element 20 are arranged such that an open end of the second extending portion 12 of the first radiating element 10 and an open end of the second extending portion 22 of the second radiating element 20 face each other.

The antenna device 301B illustrated in FIG. 1(B) is obtained by adding another set of radiating elements to the antenna device 301A. Specifically, the non-ground-conductor region NGA of the substrate 1 has a first antenna 121P composed of a set of the first radiating element 10 and the second radiating element 20, and a second antenna 121S composed of another set of the first radiating element 10 and the second radiating element 20. Feeding circuits 9P and 9S are also provided. Having the two antennas enables application to the MIMO system.

Figure 2A:
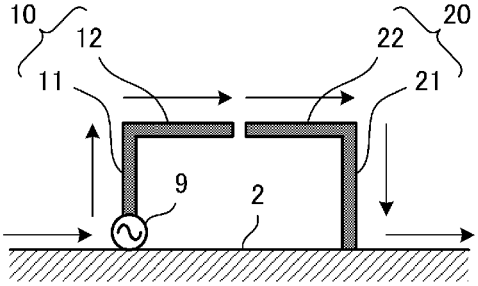
FIG. 2(A), FIG. 2(B), FIG. 2(C) and FIG. 2(D) each illustrate an antenna operation of a first radiating element 10 and a second radiating element 20.
Figure 2B:
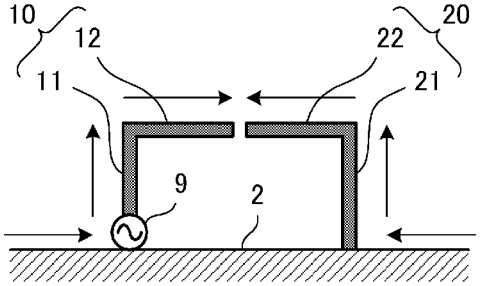
Figure 2C:
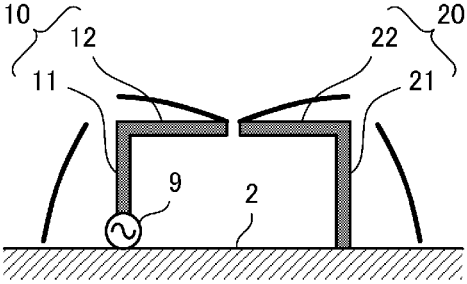
Figure 2D:
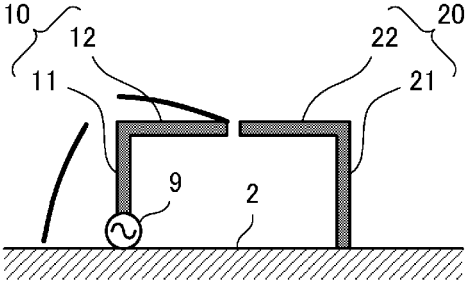

FIGS. 2(A) to 2(D) illustrate an antenna operation of the first radiating element 10 and the second radiating element 20. FIG. 2(A) is a diagram in which current flowing in the first radiating element 10, the second radiating element 20, and the ground conductor 2 in a low band (2.4 GHz band) is indicated by arrows. FIG. 2(B) is a diagram in which current flowing in the first radiating element 10, the second radiating element 20, and the ground conductor 2 in a high band (5 GHz band) is indicated by arrows. FIG. 2(C) is a diagram in which the magnitude of current of standing waves distributed in the first radiating element 10 and the second radiating element 20 in the low band (2.4 GHz band) is indicated by curves. FIG. 2(D) is a diagram in which the magnitude of current of standing waves distributed in the first radiating element 10 and the second radiating element 20 in the high band (5 GHz band) is indicated by curves.

In the low band, the second radiating element 20 is excited by the first radiating element 10. Current that is continuous in one direction flows through the first radiating element 10 and the second radiating element 20, so that the operation takes place in a dipole mode. In the high band, currents of opposite directions flow through the first radiating element 10 and the second radiating element 20, so that the operation takes place in a monopole mode.

The first radiating element 10 and the second radiating element 20 resonate in the dipole mode, which is a fundamental mode, at a frequency f1 in the low band. That is, the resonance occurs at a half wavelength. As illustrated in FIG. 2(A), the current flows along an edge portion of the ground conductor 2 (i.e., along the boundary of the region where the ground conductor 2 is formed (see GA in FIG. 1(A)) and the non-ground-conductor region (see NGA in FIG. 1(A))). Therefore, the ground conductor 2 also contributes to radiation in the dipole mode. For half-wavelength resonance of the radiating elements 10 and 20 and the ground conductor 2 in the low band, not only the element length of the radiating elements 10 and but also the length of the edge portion of the ground conductor 2 are defined.

The first radiating element 10 resonates in the monopole mode at a frequency f2 (f1<f2) in the high band. That is, the resonance occurs at a quarter wavelength.

The resonant frequency f2 in the monopole mode resonates at a wavelength longer (or frequency lower) than four times the element length of the first radiating element 10. This is probably because the resonant frequency is lowered by the effect of capacitance formed between the open end of the first radiating element 10 and the open end of the second radiating element 20. That is, the second radiating element 20, which is a parasitic radiating element, probably goes into a state in which the capacitance is loaded on the open end of the first radiating element 10, which is a feed radiating element. In the high band, as illustrated in FIG. 2(B), the currents of horizontally opposite directions flow along the edge portion of the ground conductor 2 (i.e., along the boundary of the ground-conductor region of the ground conductor 2 and the non-ground-conductor region). Therefore, the resonant frequency in the high band is determined by the element length of the first radiating element 10 and the capacitance at the open end of the first radiating element 10.

In the present disclosure, the radiating elements of the antenna are not surrounded by the ground conductor. Instead, the two L-shaped radiating elements 10 and 20 are configured to protrude from the ground-conductor region, their open ends are placed close to each other, and power is fed to the first radiating element 10, so that gain can be obtained at two frequencies away from each other.

In the antenna device 301B illustrated in FIG. 1(B), since the two antennas have the same configuration, each of the antennas have gain in the low band (2.4 GHz band) and the high band (5 GHz band).

Figure 3:
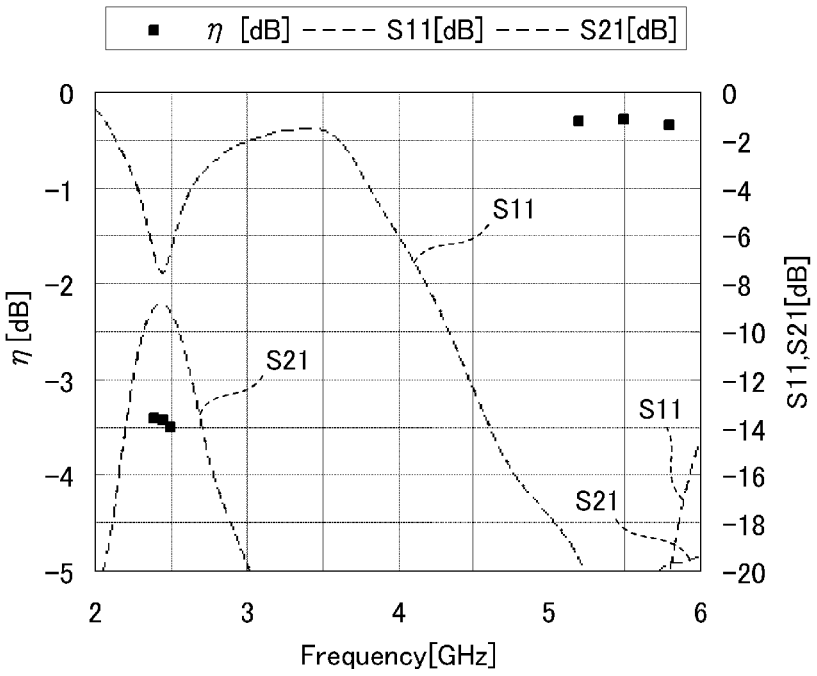
FIG. 3 illustrates antenna efficiency and S-parameters of the antenna device 301A.

FIG. 3 illustrates antenna efficiency and S-parameters of the antenna device 301A. Here, S11 represents a reflection coefficient of the antenna as seen from the feeding circuit 9, and S21 represents mutual coupling between the elements. As illustrated, matching occurs in the 2.4 GHz band (2400 MHz to 2484 MHz) and the 5 GHz band (5.15 GHz to 5.725 GHz), and high antenna efficiency is achieved.

Figure 4A:
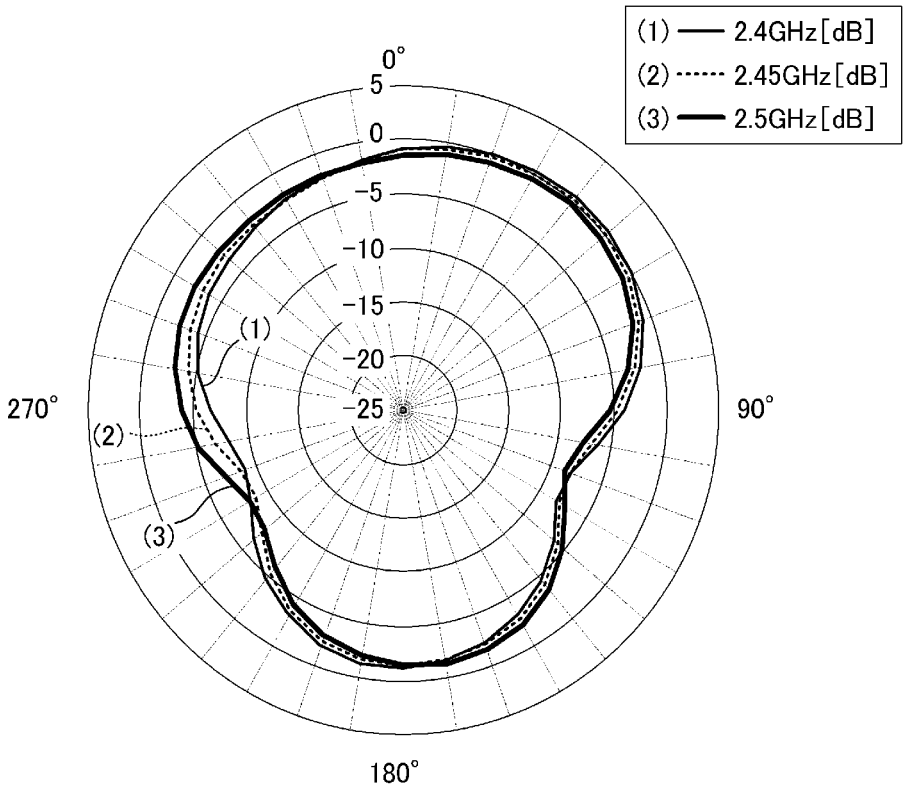
FIG. 4(A) illustrates directivity in a low band (2.4 GHz band) in an in-plane direction (within a horizontal plane) of a substrate 1.
Figure 4B:
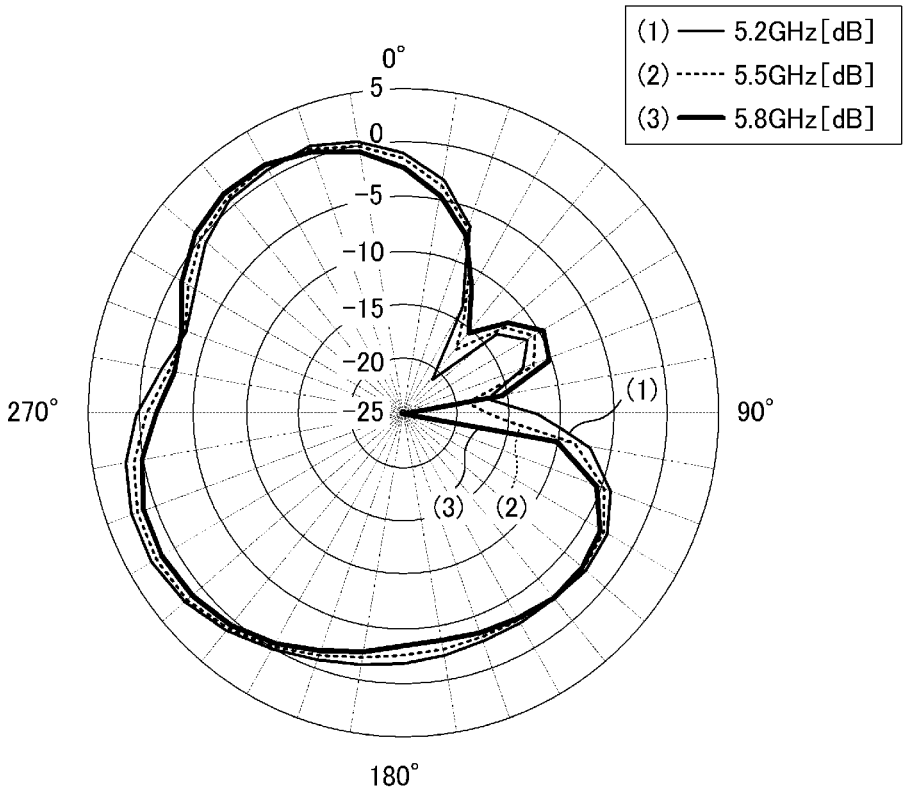
FIG. 4(B) illustrates directivity in a high band (5 GHz band) in the in-plane direction (within the horizontal plane) of the substrate 1.

FIGS. 4(A) and 4(B) illustrate directivities in an in-plane direction (within a horizontal plane) of the substrate 1. FIG. 4(A) illustrates characteristics in the low band (2.4 GHz band), and FIG. 4(B) illustrates characteristics in the high band (5 GHz band). The 0° direction is the front and the 180° direction is the rear. In the low band, directivity with high forward gain is obtained because the operation takes place in the dipole mode as described above. In the high band, high gain is also obtained in the forward direction. In the high band, since the operation takes place in the monopole mode as described above, high gain can also be obtained in the rearward direction. A monopole antenna is an antenna that uses the length direction of the substrate. Therefore, if the substrate is large in size, radiation from the substrate is larger than that from the antenna, so that gain is also obtained in the rearward direction.

In the high band, the directivity is oriented more toward the left than toward the rear (i.e., the directivity is deviated). This is probably because of the flow of current I along the left side of the ground conductor 2 illustrated in FIG. 1(A).

The substrate 1 included in the antenna device 301A or 301B described above is a printed wiring board, which has circuits of the electronic apparatus thereon. The printed wiring board is contained in a housing of the electronic apparatus. The electronic apparatus having the antenna device is thus obtained.

Second Embodiment

Figure 5A:
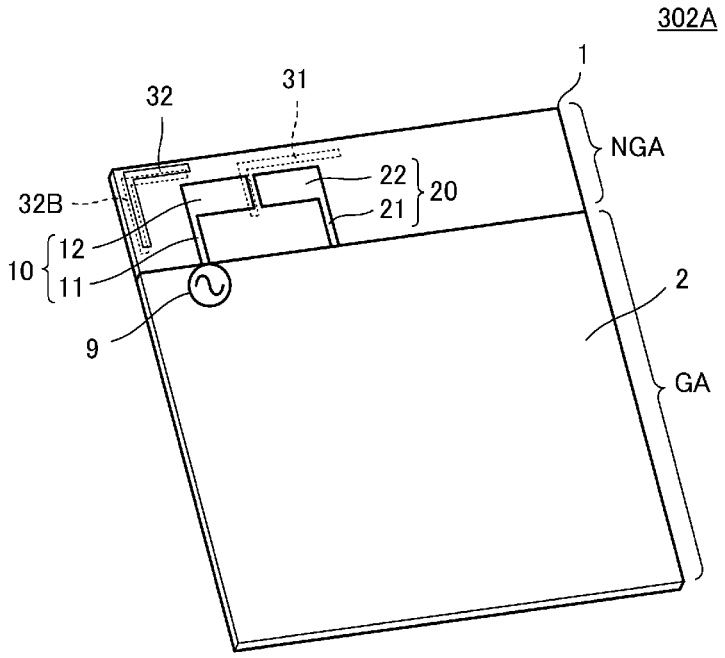
FIG. 5(A) is a perspective view of an antenna device 302A according to a second embodiment.
Figure 5B:
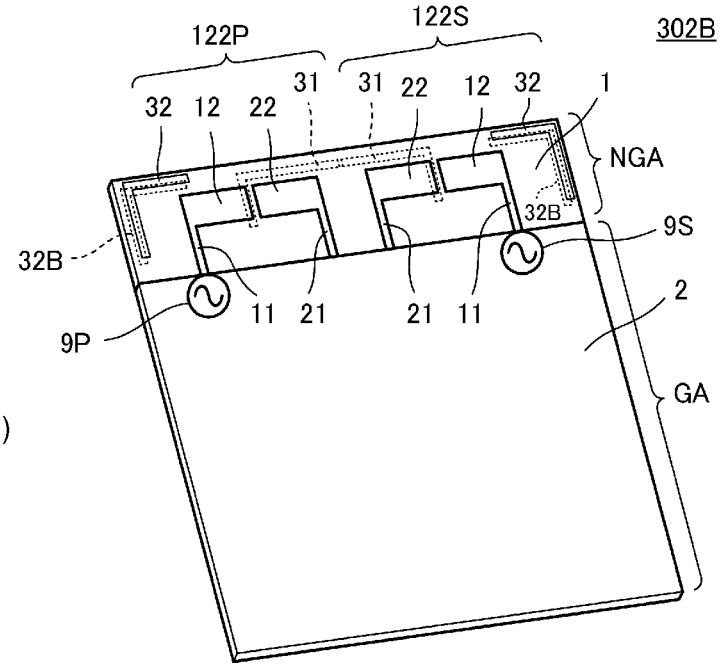
FIG. 5(B) is a perspective view of another antenna device 302B according to the second embodiment.

FIG. 5(A) is a perspective view of an antenna device 302A according to a second embodiment, and FIG. 5(B) is a perspective view of another antenna device 302B according to the second embodiment.

The antenna device 302A illustrated in FIG. 5(A) includes the substrate 1, the ground conductor 2 formed on the substrate 1, and the first radiating element 10 and the second radiating element 20 formed in the non-ground-conductor region NGA of the substrate 1. The first radiating element 10 is a feed radiating element to which the feeding circuit 9 is connected, and the second radiating element 20 is a parasitic radiating element.

The first radiating element 10 has the first extending portion 11 protruding from the region GA where the ground conductor 2 is formed to the non-ground-conductor region NGA, and the second extending portion 12 extending parallel with the boundary of the ground-conductor region GA and the non-ground-conductor region NGA. The second radiating element 20 has the first extending portion 21 protruding from the region GA where the ground conductor 2 is formed to the non-ground-conductor region NGA, and the second extending portion 22 extending parallel with the boundary of the ground-conductor region GA and the non-ground-conductor region NGA.

The first radiating element 10 and the second radiating element 20 are arranged such that the open end of the second extending portion 12 of the first radiating element 10 and the open end of the second extending portion 22 of the second radiating element 20 face each other.

A parasitic element 31 is formed along the second extending portion 22 of the second radiating element 20 on a side of the second radiating element 20 distant from the region GA where the ground conductor 2 is formed. The parasitic element 31 has an additional portion extending along the open ends of the first radiating element 10 and the second radiating element 20, so that the entire parasitic element 31 has an L shape. The parasitic element 31 is formed on the back surface of the substrate 1 so as not to contact the open ends of the first radiating element 10 and the second radiating element 20.

The parasitic element 31 extends along not only the second extending portion 22, but also along the open ends of the first radiating element 10 and the second radiating element 20. This is to achieve electric field coupling to the opening ends, and to secure a necessary element length.

A parasitic element 32 is formed along the second extending portion 12 of the first radiating element 10 on a side of the first radiating element 10 distant from the region GA where the ground conductor 2 is formed. The parasitic element 32 has an additional portion extending along the first extending portion of the first radiating element 10, so that the entire parasitic element 32 has an L shape.

The element length of the parasitic element 31 is substantially a quarter of a wavelength in the high band. By bringing the parasitic element 31 closer to the open end of the first radiating element 10, the parasitic element 31 is coupled, mainly by electromagnetic field coupling, to the first radiating element 10 on the feeding side, so that current flows in the parasitic element 31. At this point, the parasitic element 31 operates as a director.

The element length of the parasitic element 32 is substantially a quarter of a wavelength in the high band. By bringing the parasitic element 32 closer to the first radiating element 10, the parasitic element 32 is coupled, mainly by electromagnetic field coupling, to the first radiating element 10 on the feeding side, so that current flows in the parasitic element 32. At this point, the parasitic element 32 operates as a director.

As described above, since the parasitic elements 31 and 32 disposed forward of the first radiating element 10 and the second radiating element 20 each operate as a director, the directivity in the high band is oriented toward the front and the gain in the forward direction can be improved.

The antenna device 302B illustrated in FIG. 5(B) is obtained by adding another set of radiating elements to the antenna device 302A. Specifically, the non-ground-conductor region NGA of the substrate 1 has a first antenna 122P composed of a set of the first radiating element 10, the second radiating element 20, and the parasitic elements 31 and 32, and a second antenna 122S composed of another set of the first radiating element 10, the second radiating element 20, and the parasitic elements 31 and 32. The feeding circuits 9P and 9S are also provided. Having the two antennas enables application to the MIMO system.

Figure 6:
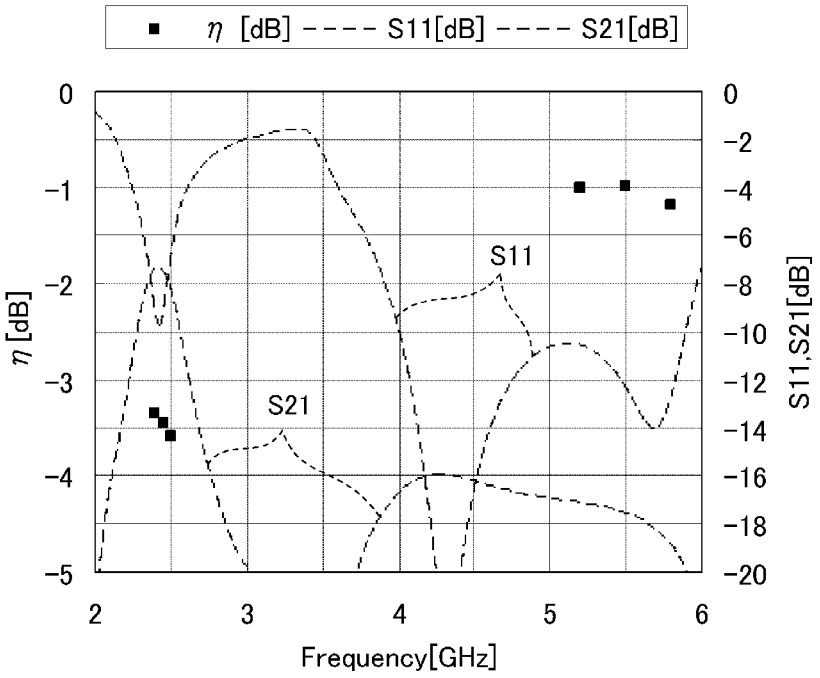
FIG. 6 illustrates antenna efficiency and S-parameters of the antenna device 302A.

FIG. 6 illustrates antenna efficiency and S-parameters of the antenna device 302A. Here, S11 represents a reflection coefficient of the antenna as seen from the feeding circuit 9, and S21 represents mutual coupling between the elements.

As illustrated, matching occurs in the 2.4 GHz band (2400 MHz to 2497 MHz) and the 5 GHz band (5.15 GHz to 5.725 GHz), and high antenna efficiency is achieved.

Figure 7A:
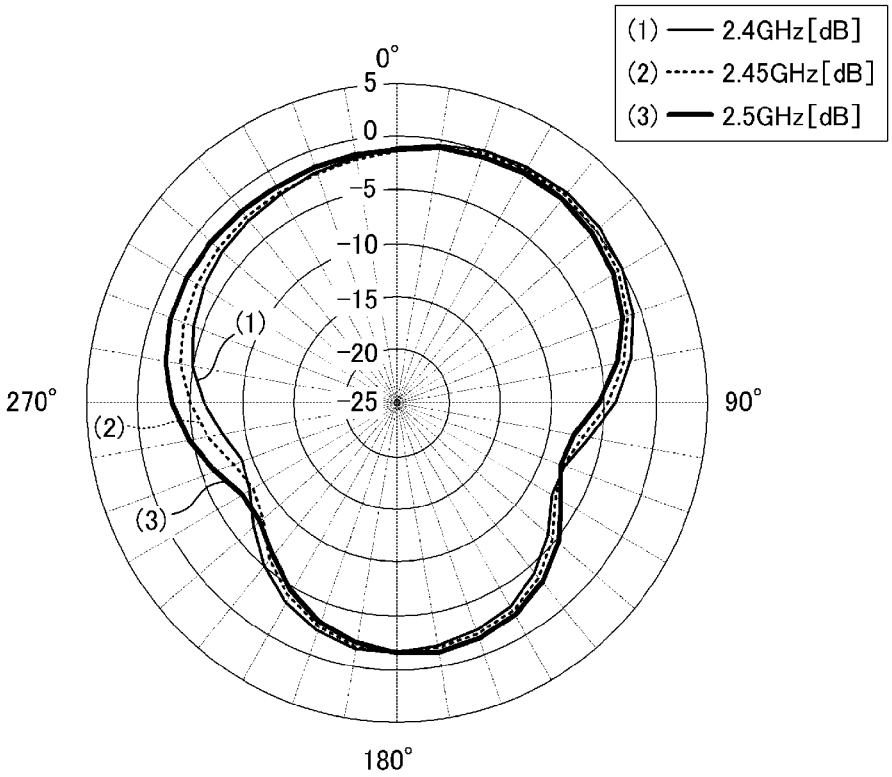
FIG. 7(A) illustrates directivity in the low band (2.4 GHz band) in the in-plane direction (within the horizontal plane) of the substrate 1.
Figure 7B:
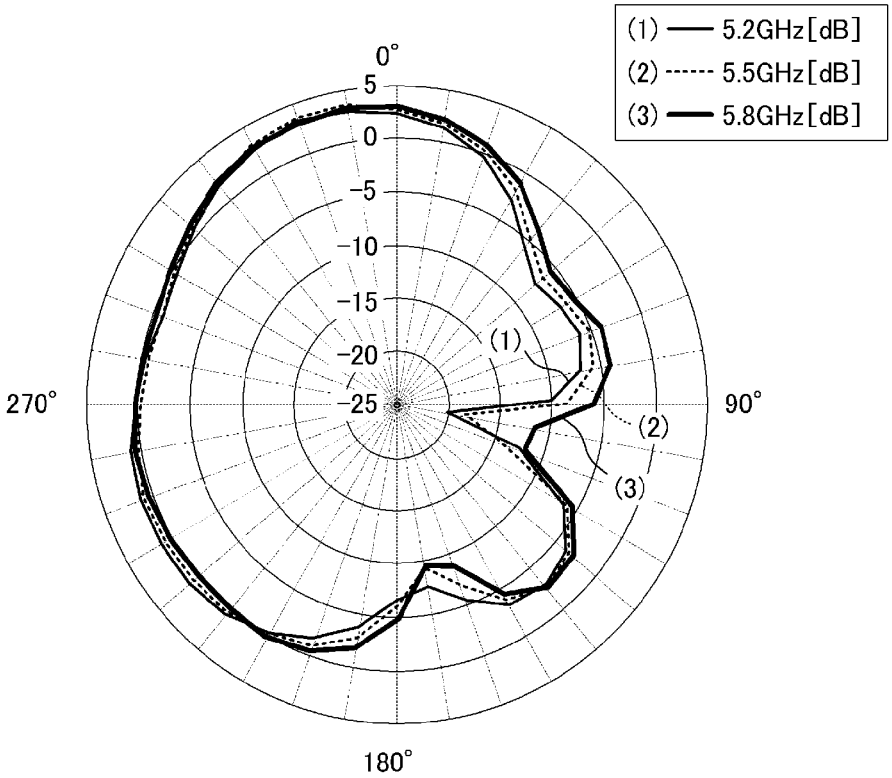
FIG. 7(B) illustrates directivity in the high band (5 GHz band) in the in-plane direction (within the horizontal plane) of the substrate 1.

FIGS. 7(A) and 7(B) illustrate directivities in the in-plane direction (within the horizontal plane) of the substrate 1. FIG. 7(A) illustrates characteristics in the low band (2.4 GHz band), and FIG. 7(B) illustrates characteristics in the high band (5 GHz band). The 0° direction is the front and the 180° direction is the rear.

Table 1 shows differences in average gain in the forward direction (−90 degrees to 90 degrees) between the cases with and without the parasitic elements 31 and 32.

TABLE 1

| | Average gain at −90 degrees to 90 degrees (dB) | | | | | |
|---|---|---|---|---|---|---|
| | 2.4 GHz | 2.45 GHz | 2.5 GHz | 5.2 GHz | 5.5 GHz | 5.8 GHz |
| With parasitic elements 31, 32 | −2.1 | −2.0 | −1.8 | −1.8 | −1.3 | −0.7 |
| Without parasitic elements 31, 32 | −2.1 | −2.1 | −1.9 | −6.1 | −6.1 | −6.3 |
| Difference | 0.1 | 0.1 | 0.2 | 4.4 | 4.9 | 5.6 |

With the parasitic elements 31 and 32, the average gain in the forward direction (−90 degrees to 90 degrees) in the high band is 4.4 dB to 5.6 dB higher than that in the case without the parasitic elements 31 and 32 (see Table 1).

In the low band, since the operation takes place in the dipole mode as described above, directivity can be obtained which has high gain in the direction (forward direction) in which the radiating elements 10 and 20 protrude from the region GA where the ground conductor 2 is formed. Directivity with high forward gain can also be obtained in the high band.

Third Embodiment

Figure 8A:
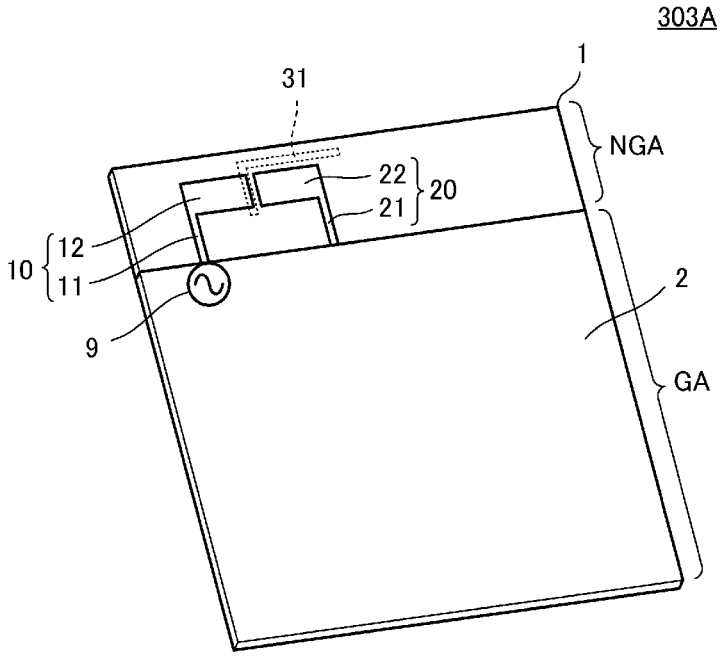
FIG. 8(A) is a perspective view of an antenna device 303A according to a third embodiment.
Figure 8B:
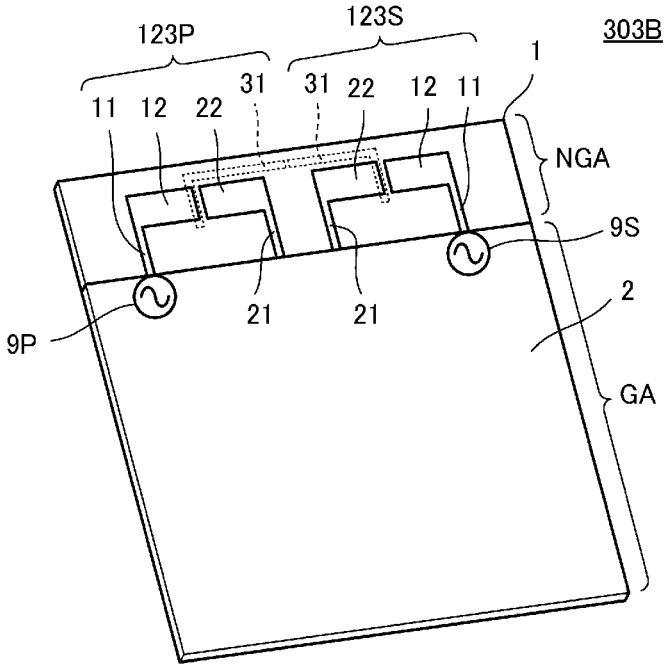
FIG. 8(B) is a perspective view of another antenna device 303B according to the third embodiment.

FIG. 8(A) is a perspective view of an antenna device 303A according to a third embodiment, and FIG. 8(B) is a perspective view of another antenna device 303B according to the third embodiment.

The antenna device 303A illustrated in FIG. 8(A) includes the substrate 1, the ground conductor 2 formed on the substrate 1, and the first radiating element 10 and the second radiating element 20 formed in the non-ground-conductor region NGA of the substrate 1. The first radiating element 10 is a feed radiating element to which the feeding circuit 9 is connected, and the second radiating element 20 is a parasitic radiating element. The antenna device 303A of the third embodiment includes the parasitic element 31, but, unlike the antenna device illustrated in FIG. 5(A), the antenna device 303A does not include the parasitic element 32.

The antenna device 303B illustrated in FIG. 8(B) is obtained by adding another set of radiating elements to the antenna device 303A. Specifically, the non-ground-conductor region NGA of the substrate 1 has a first antenna 123P composed of a set of the first radiating element 10, the second radiating element 20, and the parasitic element 31, and a second antenna 123S composed of another set of the first radiating element 10, the second radiating element 20, and the parasitic element 31. Having the two antennas enables application to the MIMO system.

Figure 9A:
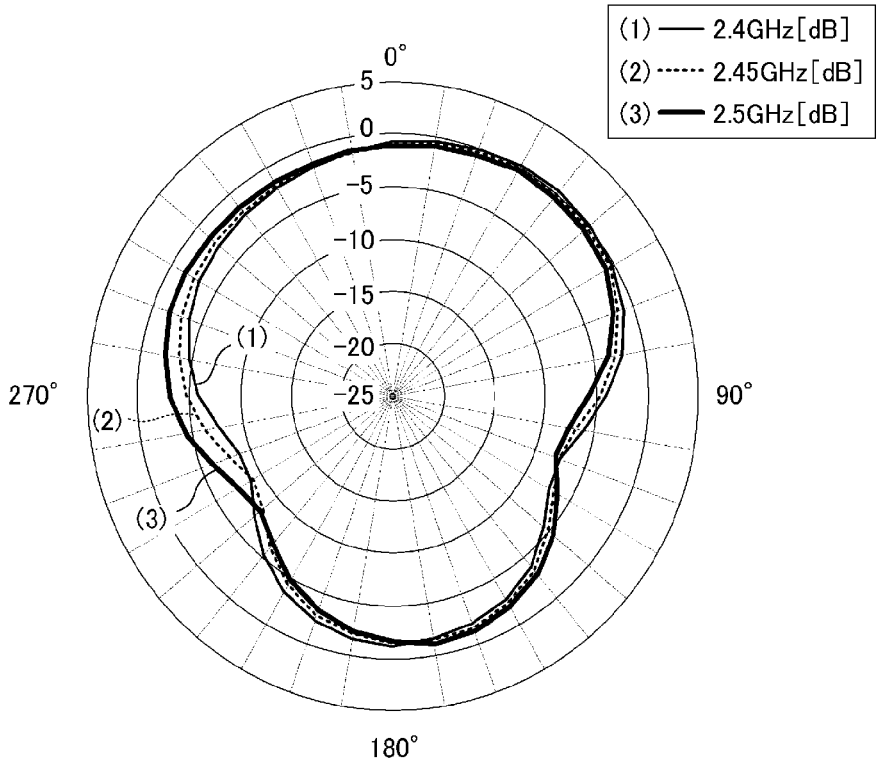
FIG. 9(A) illustrates directivity in the low band (2.4 GHz band) in the in-plane direction (within the horizontal plane) of the substrate 1.
Figure 9B:
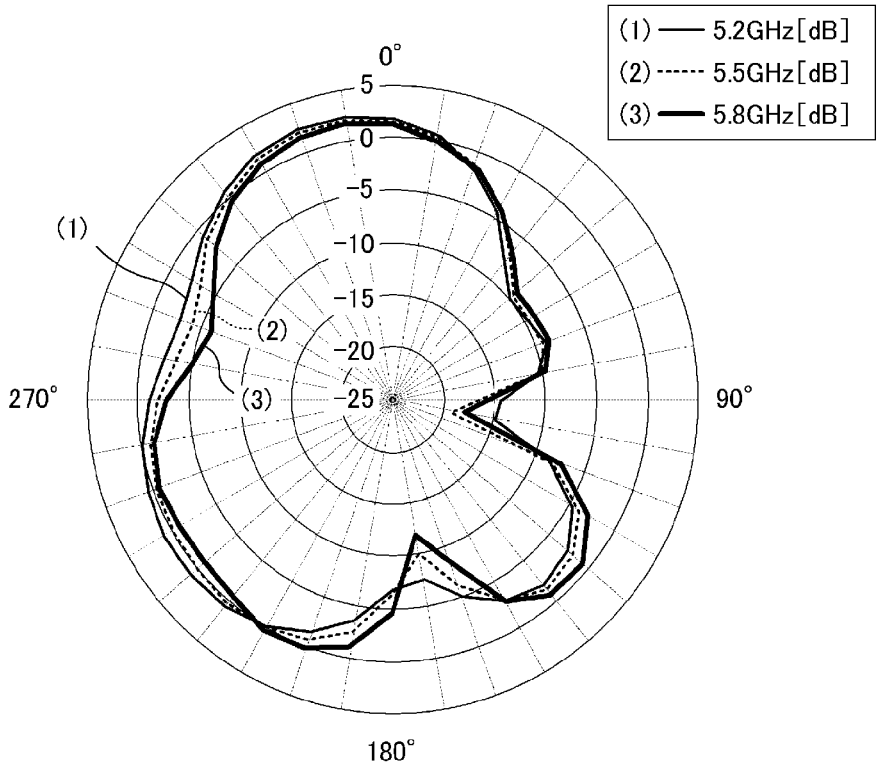
FIG. 9(B) illustrates directivity in the high band (5 GHz band) in the in-plane direction (within the horizontal plane) of the substrate 1.

FIGS. 9(A) and 9(B) illustrate directivities in the in-plane direction (within the horizontal plane) of the substrate 1. FIG. 9(A) illustrates characteristics in the low band (2.4 GHz band), and FIG. 9(B) illustrates characteristics in the high band (5 GHz band). The 0° direction is the front and the 180° direction is the rear.

Table 2 shows differences in average gain in the forward direction (−90 degrees to 90 degrees) between the cases with both the parasitic elements 31 and 32 and with only the parasitic element 31.

TABLE 2

| | Average gain at −90 degrees to 90 degrees (dB) | | | | | |
|---|---|---|---|---|---|---|
| | 2.4 GHz | 2.45 GHz | 2.5 GHz | 5.2 GHz | 5.5 GHz | 5.8 GHz |
| With parasitic elements 31, 32 | −2.1 | −2.0 | −1.8 | −1.8 | −1.3 | −0.7 |
| With parasitic element 31 and without parasitic element 32 | −2.0 | −2.0 | −1.8 | −3.5 | −3.8 | −4.2 |
| Difference | −0.1 | 0.0 | 0.0 | 1.7 | 2.6 | 3.5 |

Adding only the parasitic element 31 improves the average gain in the forward direction. However, as compared to the cases with both the parasitic elements 31 and 32, the average gain in the forward direction (−90 degrees to 90 degrees) is 1.7 dB to 3.5 dB lower in the 5 GHz band.

Figure 10A:
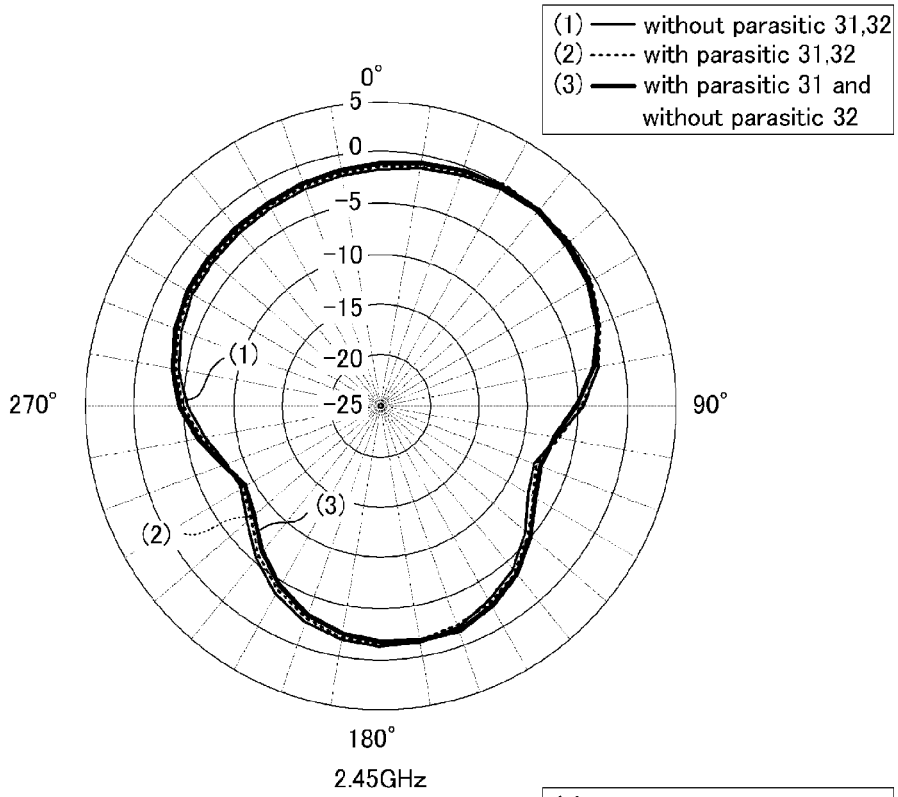
FIGS. 10(A) and 10(B) illustrate differences in directivity depending on the presence or absence of parasitic elements 31 and 32.
Figure 10B:
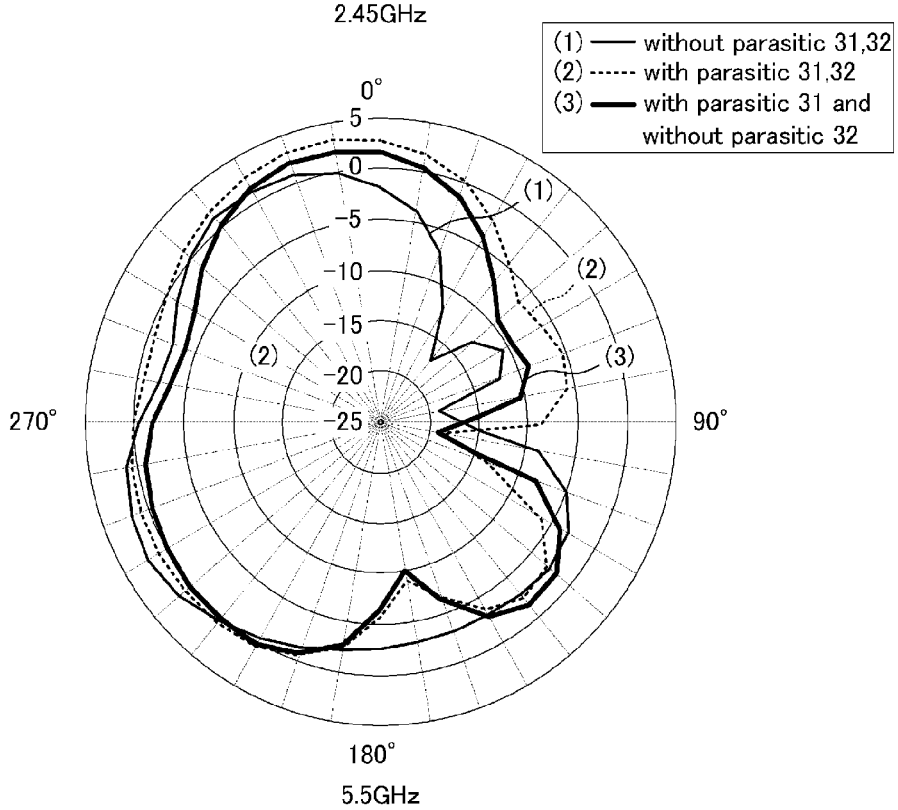

FIGS. 10(A) and 10(B) illustrate differences in directivity depending on the presence or absence of the parasitic elements 31 and 32. FIG. 10(A) illustrates characteristics in the low band (2.4 GHz band), and FIG. 10(B) illustrates characteristics in the high band (5 GHz band). In FIG. 10(A) and FIG. 10(B), (1) represents the case without the parasitic elements 31 and 32, (2) represents the case with the parasitic elements 31 and 32, and (3) represents the case with the parasitic element 31 and without the parasitic element 32. The 0° direction is the front and the 180° direction is the rear. As shown in FIG. 10(B), the presence of the parasitic element 31 significantly improves the forward gain in the high band, and adding the parasitic element 32 further improves the forward gain.

Fourth Embodiment

Figure 11:
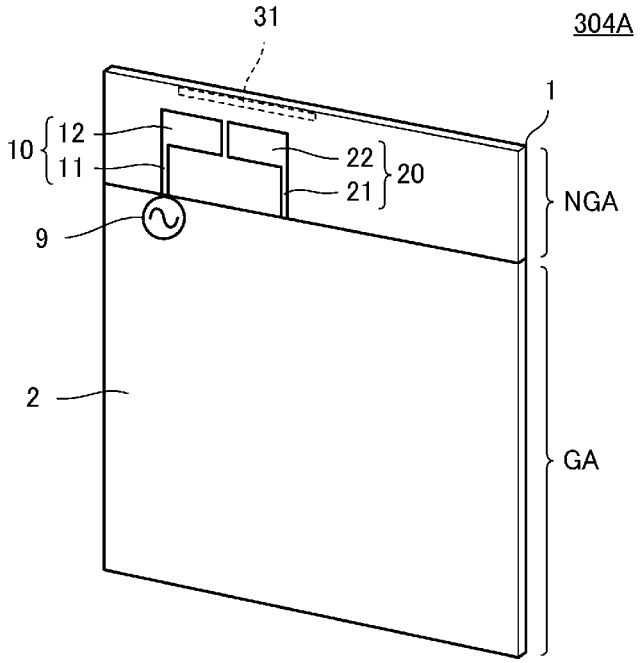
FIG. 11 is a perspective view of an antenna device 304A according to a fourth embodiment.
Figure 12:
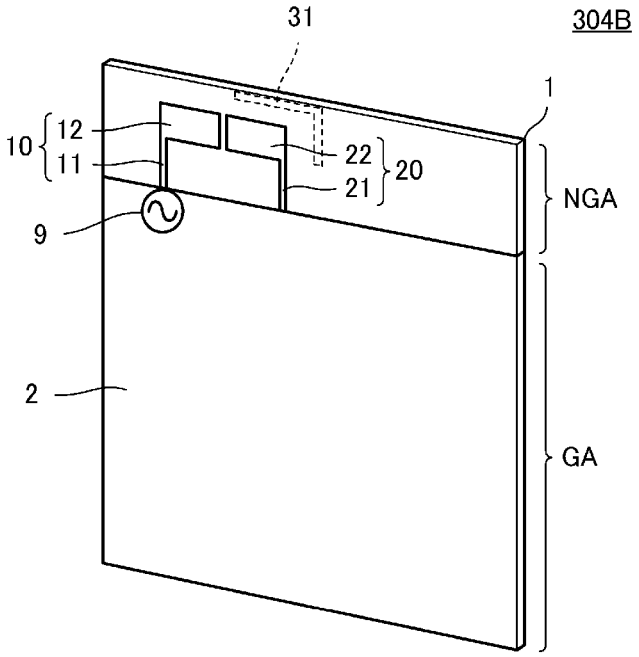
FIG. 12 is a perspective view of another antenna device 304B according to the fourth embodiment.

FIG. 11 is a perspective view of an antenna device 304A according to a fourth embodiment. FIG. 12 is a perspective view of another antenna device 304B according to the fourth embodiment.

The antenna device 304A illustrated in FIG. 11 and the antenna device 304B illustrated in FIG. 12 each include the substrate 1, the ground conductor 2 formed on the substrate 1, and the first radiating element 10 and the second radiating element 20 formed in the non-ground-conductor region NGA of the substrate 1. The first radiating element 10 is a feed radiating element to which the feeding circuit 9 is connected, and the second radiating element 20 is a parasitic radiating element.

A difference from the antenna device 301A illustrated in FIG. 1(A) is that the antenna device 304A and the antenna device 304B include the parasitic element 31. One part of the parasitic element 31 is formed along the second extending portion 22 of the second radiating element on a side of the second radiating element 20 distant from the region GA where the ground conductor 2 is formed.

In the example of FIG. 11, the parasitic element 31 further extends along the second extending portion 12 of the first radiating element 10. In the example of FIG. 12, the parasitic element 31 further extends along the first extending portion 21 of the second radiating element 20.

The parasitic element 31 can operate as a director even when the parasitic element 31 extends along the second radiating element 20 which is a parasitic radiating element. It is thus possible to increase gain in the forward direction in the high band.

Figure 13A:
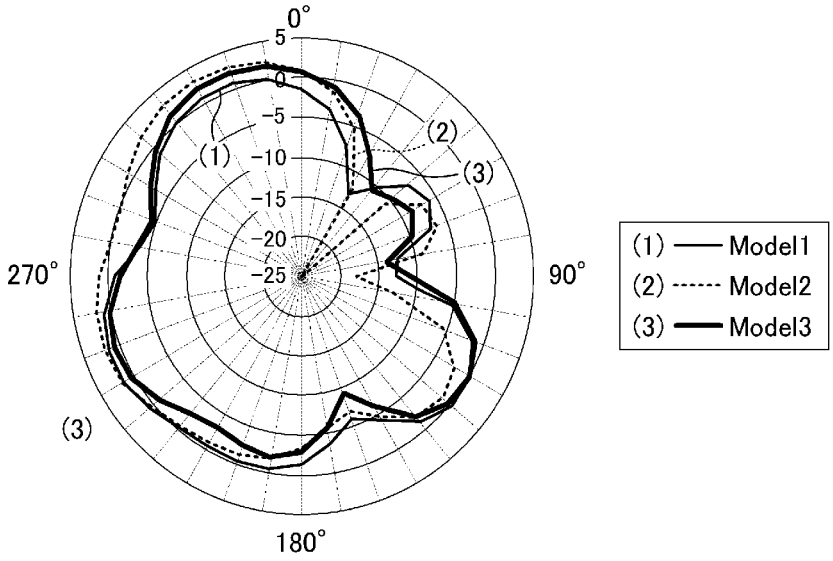
FIG. 13(A), FIG. 13(B) and FIG. 13(C) illustrate directivities of the antenna devices according to the first to fourth embodiments in the high band.
Figure 13B:
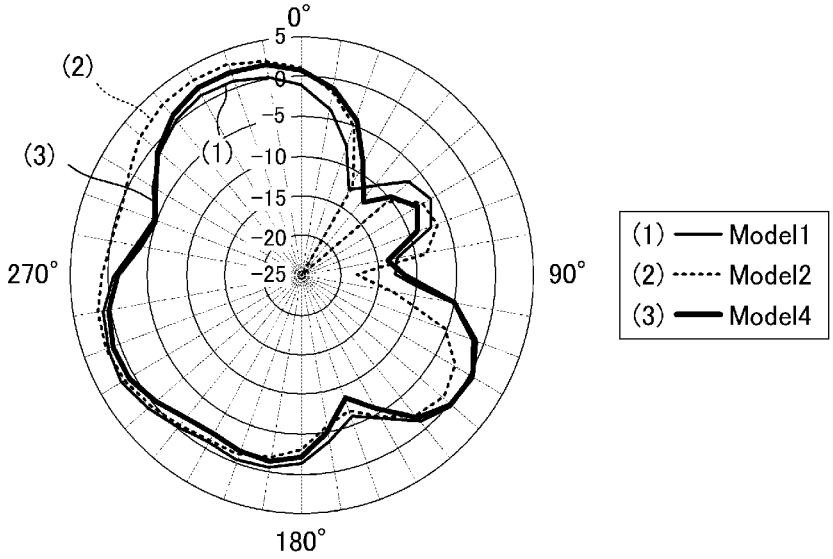
Figure 13C:
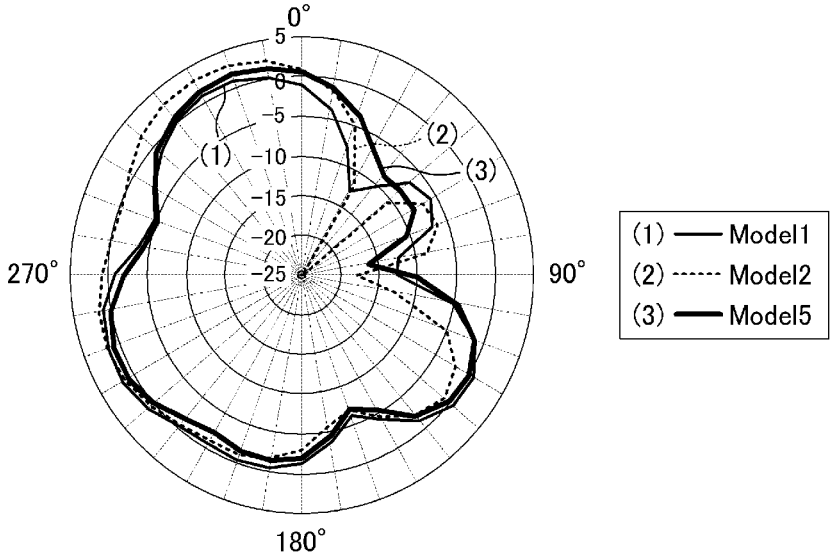

FIG. 13(A), FIG. 13(B), and FIG. 13(C) illustrate directivities of the antenna devices according to the first to fourth embodiments in the high band. Model1 corresponds to the antenna device 301A of the first embodiment illustrated in FIG. 1(A), Model2 corresponds to the antenna device 302A of the second embodiment illustrated in FIG. 5(A), Model3 corresponds to the antenna device 303A of the third embodiment illustrated in FIG. 8(A), Model4 corresponds to the antenna device 304A illustrated in FIG. 11, and Model5 corresponds to the antenna device 304B illustrated in FIG. 12. FIG. 13(A) shows directivities of Model1, Model2, and Model3 in a superimposed manner, FIG. 13(B) shows directivities of Model1, Model2, and Model4 in a superimposed manner, and FIG. 13(C) shows directivities of Model1, Model2, and Model5 in a superimposed manner.

Average gains in the forward direction (−90 degrees to 90 degrees) are as follows.

Model1 −4.9 dB
Model2 −4.2 dB
Model3 −4.2 dB
Model4 −4.5 dB
Model5 −4.4 dB

Although the result shows that the forward gain of the antenna device 302A corresponding to Model2 is the highest, the forward gain of any of Model3, Model4, and Model5 is improved.

Other Embodiments

In each of the embodiments described above, the first radiating element, the second radiating element, and the parasitic element are formed by a conductive pattern on a printed wiring board. However, the present disclosure is not limited to the configuration in which they are formed by a conductive pattern, and they may be formed by a chip element or a molded metal sheet. For example, the first radiating element 10 or the second radiating element 20 may be formed by a chip antenna obtained by forming the second extending portion 12 or 22 on the surface of a dielectric chip in the shape of a rectangular parallelepiped. The parasitic element 31 or 32 may be formed by attaching a molded metal sheet to a printed wiring board.

In the embodiments described above, the second extending portion 12 of the first radiating element 10 and the second extending portion 22 of the second radiating element 20 extend parallel with the boundary of the ground-conductor region GA and the non-ground-conductor region NGA. Here, the term "parallel" does not mean being mathematically parallel. It is only necessary that the second extending portions be parallel with the boundary to the extent of being able to contribute to radiation, and that the forward gain in the monopole mode operation be improved by the presence of the parasitic element extending along the second extending portions. That is, term "parallel" includes "being substantially parallel".

The invention claimed is:

1. An antenna device comprising a substrate;

a ground conductor formed on a principal surface of the substrate;

a radiating element formed in a non-ground-conductor region of the substrate, the non-ground-conductor region being a region where the ground conductor is not formed and being on the principal surface of the substrate;

the radiating element being composed of a first radiating element and a second radiating element;

a parasitic element in the non-ground-conductor region, said parasitic element not in electrical contact with either the radiating element or the ground conductor; and a feeding circuit; wherein the first radiating element and the second radiating element each have a first extending portion protruding from a ground-conductor region to the non-ground-conductor region, the ground-conductor region being a region where the ground conductor is formed, and a second extending portion extending parallel with a boundary of the ground-conductor region and the non-ground-conductor region;

the first extending portion and the second extending portion are L-shaped;

the first radiating element and the second radiating element are arranged such that an open end of the second extending portion of the first radiating element and an open end of the second extending portion of the second radiating element face each other;

the first radiating element is a feed radiating element to which the feeding circuit is connected; and the second radiating element is a parasitic radiating element.

2. The antenna device according to claim 1, wherein there are a plurality of sets of the first radiating element and the second radiating element.

3. The antenna device according to claim 1, wherein the parasitic element is arranged on a side of the first radiating element and the second radiating element distant from the ground conductor, the parasitic element extending along the second extending portion of at least one of the first radiating element and the second radiating element.

4. The antenna device according to claim 3, wherein the parasitic element has a portion extending along the open ends of the first radiating element and the second.

5. The antenna device according to claim 4, wherein the portion extending along the open ends of the first radiating element and the second radiating element is between the open end of the second extending portion of the first radiating element and the open end of the second extending portion of the second radiating element.

6. The antenna device according to claim 3, wherein the parasitic element has a portion extending along the first extending portion of one of the first radiating element and the second radiating element.

* * * * *